US008714307B2

(12) United States Patent
Burnett

(10) Patent No.: US 8,714,307 B2
(45) Date of Patent: May 6, 2014

(54) PORTABLE WORKSTATION STRUCTURE

(76) Inventor: Barry N. Burnett, Essex Junction, VT (US)

( * ) Notice: Subject to any disclaimer, the term of this patent is extended or adjusted under 35 U.S.C. 154(b) by 12 days.

(21) Appl. No.: 13/323,256

(22) Filed: Dec. 12, 2011

(65) Prior Publication Data

US 2012/0312202 A1 Dec. 13, 2012

Related U.S. Application Data

(60) Provisional application No. 61/459,368, filed on Dec. 13, 2010, provisional application No. 61/463,766, filed on Feb. 23, 2011.

(51) Int. Cl.
*E04G 1/00* (2006.01)

(52) U.S. Cl.
USPC ..... 182/181.1; 182/151; 248/188.1; 248/346.01; 248/346.03; 211/194

(58) Field of Classification Search
USPC ..... 182/186.5, 181.1, 151, 222, 224; 404/9; 116/63 P; 108/91, 187, 180, 186; 211/188, 194, 189–191; 248/49, 65, 248/68.1, 73, 346.01, 346.03, 346.3, 346.5, 248/188.1, 188.3, 188.8; 52/651.1; 206/503, 505, 515, 518
See application file for complete search history.

(56) References Cited

U.S. PATENT DOCUMENTS

| | | | | |
|---|---|---|---|---|
| 5,030,029 | A * | 7/1991 | Johnsen | 404/6 |
| 6,364,133 | B1 * | 4/2002 | Sheng | 211/46 |
| 6,619,601 | B1 * | 9/2003 | Vall | 248/188 |
| 7,967,157 | B2 * | 6/2011 | Bilotto | 211/194 |
| 2010/0162942 | A1 * | 7/2010 | Karow et al. | 116/63 P |

* cited by examiner

*Primary Examiner* — Charles A Fox
*Assistant Examiner* — Kristine Florio
(74) *Attorney, Agent, or Firm* — Downs Rachlin Martin PLLC

(57) ABSTRACT

A support structure of the present disclosure provides a stable and expansible material storage system or work platform. The support platform includes a plurality of apertures, typically sized and configured to receive standard grade lumber sizes. The support platform may be used singly for storing materials or for working on the materials or two or more additional support structures can be combined to support multiple work pieces in a tiered and/or side-by-side arrangement, or to create a stable workstation. The material support capability of support structure is also expansible both horizontally and vertically, and for ease of storage, multiple support structures are nestable or may be individually collapsible.

10 Claims, 6 Drawing Sheets

PORTABLE WORKSTATION STRUCTURE

RELATED APPLICATION DATA

This application claims the benefit of priority of U.S. Provisional Patent Application Ser. No. 61/459,368, filed Dec. 13, 2010, and titled "All Trades Multiple Work Station and Sawhorse" and U.S. Provisional Patent Application Ser. No. 61/463,766, filed Feb. 23, 2011, and titled "All Trades Multiple Use Portable Work Station and Sawhorse", each of which are incorporated by reference herein in their entirety.

FIELD OF THE INVENTION

The present invention generally relates to the field of portable support structures. In particular, the present invention is directed to a Portable Workstation Structure.

BACKGROUND

Jobsite workstations and storage racks for plumbers, carpenters, roofers, and other trades are typically limited to a few sawhorses used to support construction materials or a work piece while the materials or work piece is being stored, sawed, painted, or otherwise modified. While sawhorses are suitable for these purposes and, when combined with other materials, can provide an elevated work surface, sawhorses fail to provide a flexible and expansible work environment for improved staging and working of materials.

SUMMARY OF THE DISCLOSURE

In a first exemplary aspect, a support structure for supporting construction materials or work pieces or for the creation of a work surface is disclosed, the support structure comprising: a plurality of sidewalls each including a pair of parallel edges and a pair of converging edges; and a plurality of apertures, wherein a first aperture is disposed in a first sidewall and a second aperture is disposed in an opposing second sidewall, wherein the first and second apertures are aligned, wherein ones of the plurality of sidewalls are coupled along respective ones of the pairs of converging edges such that each of the converging edges couples to another of the converging edges so as to form a truncated pyramid, and wherein the first and second apertures are sized and configured to accept and support a supporting member placed through the first aperture and the second aperture.

In another exemplary aspect, a staging system is disclosed that comprises a first and second set of support structures, wherein each of the support structures includes: a plurality of sidewalls; and a plurality of apertures evenly distributed in the vertical direction on opposing sidewalls, wherein pairs of the plurality of apertures reside in the same horizontal plane; and a first plurality of support members, wherein each of the first plurality of support members is inserted into one of the pairs of the plurality of apertures in each of the first set of support structures; and a second plurality of support members, wherein each of the second plurality of support members is inserted into one of the pairs of the plurality of apertures in each of the second set of support structures.

In yet another exemplary aspect, a method of staging materials is disclosed, the method comprising: providing a first and a second set of support structures, wherein each set of support structures includes: a plurality of sidewalls; a plurality of apertures evenly distributed in the vertical direction on opposing sidewalls, wherein pairs of the plurality of apertures reside in the same horizontal plane; and inserting a first support member into opposing ones of the plurality of apertures of the first set of support structures; and inserting a second support member into opposing ones of the plurality of apertures of a second set of support structures, wherein the first support member and the second support member create a first horizontal platform; placing materials on the first horizontal platform.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

The portable support structure of the present disclosure is a versatile tool for all trades and professions with need for a stable and expansible material storage system or work platform. A portable support structure 100, as described further herein, can be used singly for storing materials or for working on the materials. Two or more additional support structures 100 can be combined to support multiple work pieces in a tiered and/or side-by-side arrangement, or to create a stable workstation. The material support capability of support structure 100 is also expansible both horizontally and vertically, and for ease of storage, multiple support structures are nestable or may be individually collapsible.

Figure 1:
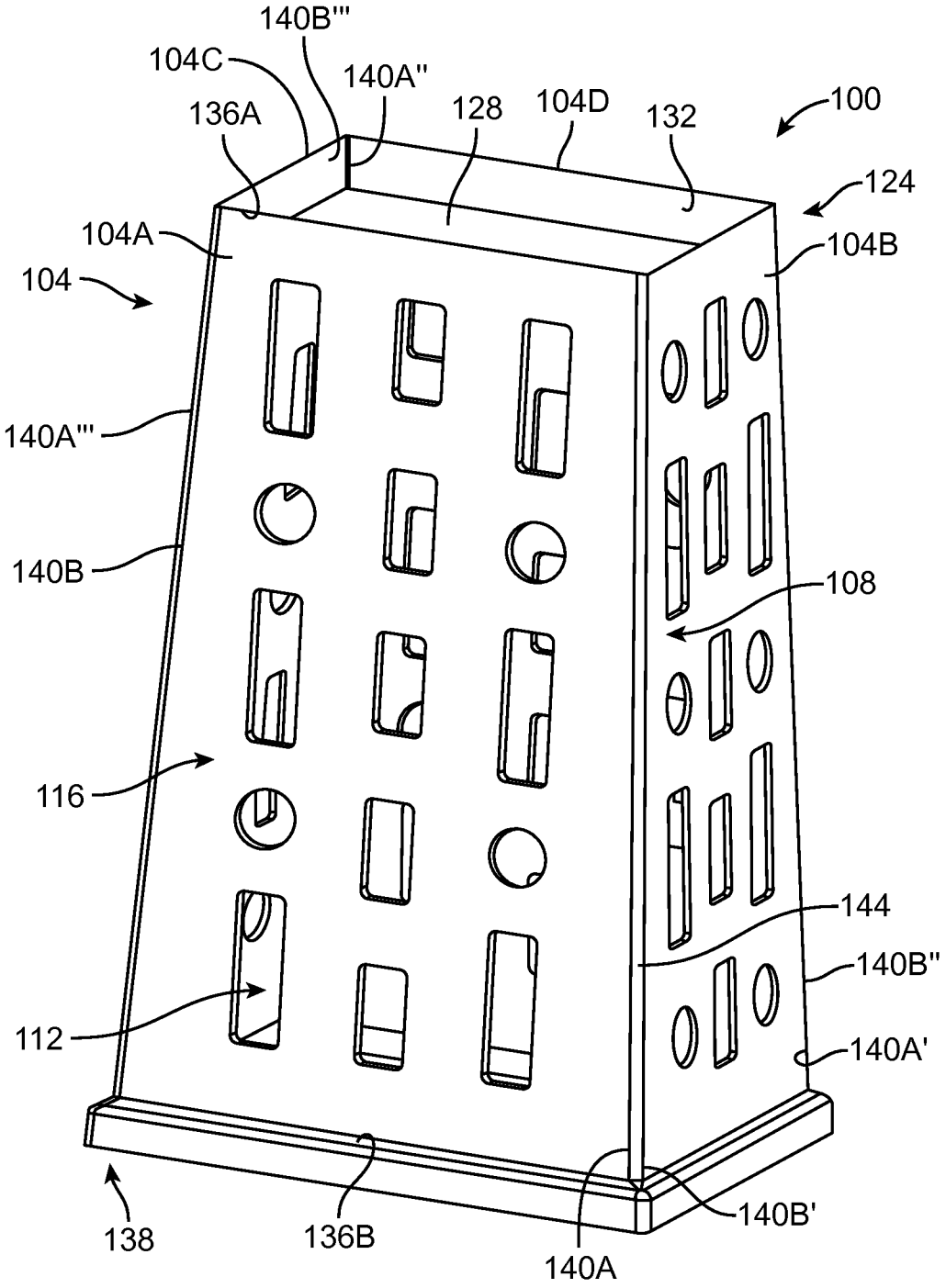
FIG. 1 is a perspective view of a portable support structure according to an embodiment of the present invention.

Turning now to an exemplary embodiment of portable support structure 100 shown in FIG. 1, the support structure includes a plurality of sidewalls 104 that are coupled together along edges 108. The joining of each sidewall 104 together forms a cavity 112 within support structure 100. Each sidewall can include one or more apertures 116 suitable for receiving support members 120 (e.g., one or more work pieces or shelves, examples of which are shown in, for example FIG. 2). In certain embodiments, support structure 100 can also include a top 124, which as shown in FIG. 1, is recessed within cavity 112 so as to provide a platform 128 having a ridge 132. Support structure may also include a base 138.

In an exemplary embodiment, each sidewall 104, i.e., sidewalls 104A, 104B, 104C, and 104D, is generally trapezoidal in shape, thus having a pair of parallel edges, edges 136A-B, and a pair of converging edges, 140A-B. Each sidewall 104 is coupled to another sidewall 104 along a converging edge 140. For example, sidewall 104A is coupled to sidewall 104B via converging edge 140A and 140W. Sidewalls 104 may be coupled together via a hinge mechanism 144 (discussed in more detail with reference to FIG. 6). In another embodiment, support structure 100 may be of unitary blow-molded plastic construction which provides a seamless connection between sidewalls 104, and, in certain embodiments, top 124.

Figure 2:
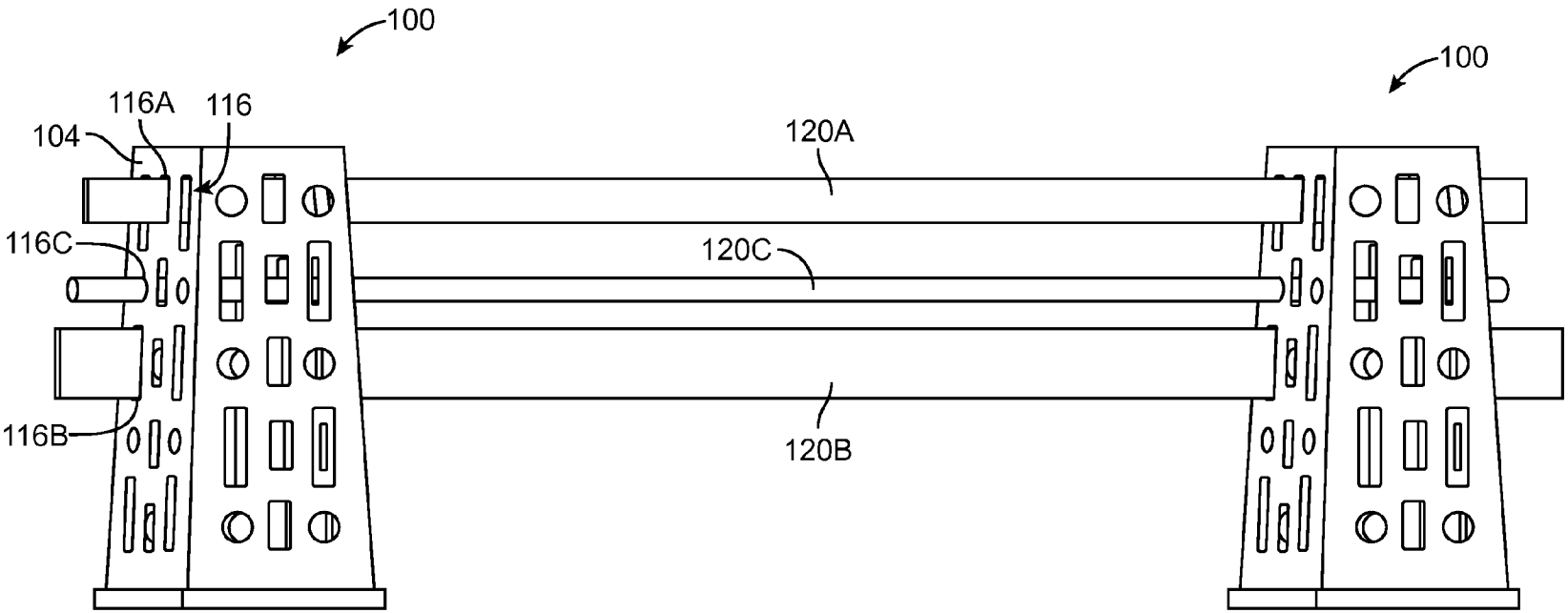
FIG. 2 is a perspective view of portable support structures including support members according to an embodiment of the present invention.
Figure 3:
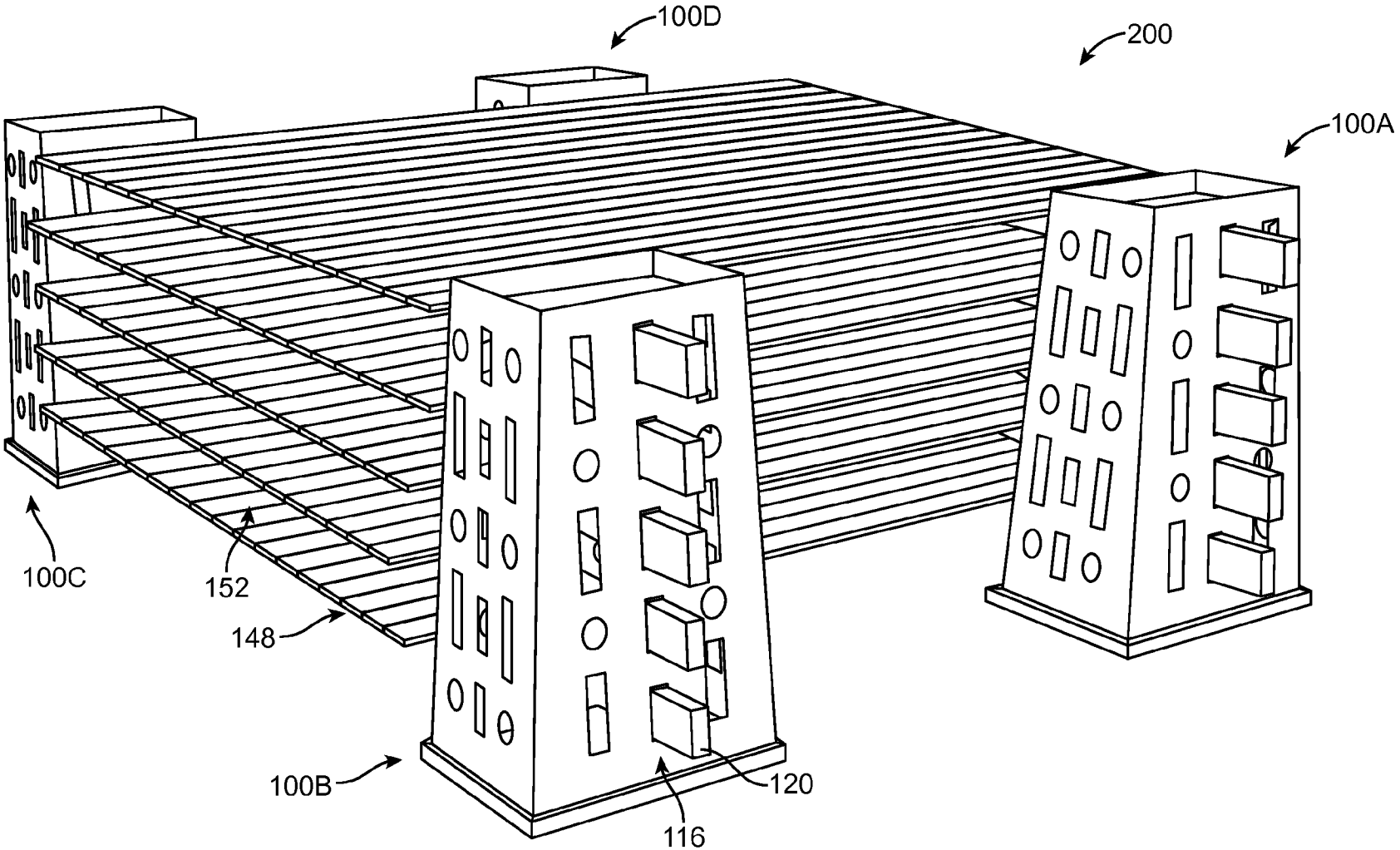
FIG. 3 is a perspective view of a staging system according to an embodiment of the present invention.

Referring now to FIGS. 1 and 2, apertures 116 extend through each sidewall 104 and are typically sized and configured to accept and support one or more support members 120. Apertures 116 may accommodate various shapes of support members 120. For example, apertures 116A-B may be sized and configured to receive rectangular support members 120A and 120B and aperture 116C may be sized and configured to receive a circular support member 120C. In an embodiment, apertures 116 are sized and configured to receive standard sized construction materials, for example, a wood 2×4 (having rough dimensions of 1.5 inches by 3.5 inches), a wood 2×6 (having rough dimensions of 1.5 inches by 5.5 inches), or various diameters of pipe or conduit. Apertures 116 may also include a clearance amount so as to assist in assembly and disassembly of the support structure or staging system (FIG. 3). A suitable clearance amount may be about 0.25 inches greater than the width and height of support member 120, when the support member is substantially rectangular, and about 0.25 inches greater than the diameter of the support member when the support member is substantially circular. The location, number, and size of apertures 116 in sidewalls 104 may vary depending on the needs of the tradesperson, the load capacity desired of support structure 100, and the desired weight of the support structure. Apertures 116 may also be uniformly spaced in the vertical direction on each sidewall 104 such that apertures lie on the several horizontal planes. Alternatively, and as shown in FIG. 1, apertures 116 on adjacent sidewalls 104 are offset in the vertical direction so as to permit the construction of crisscrossed staging areas.

Top 120 can include a platform 128 and a ridge 132. Platform 128 is generally square and, in the embodiment shown in FIG. 1, is mounted to each sidewall 104. The size of platform 128 is related to the length of edges 136 and as such may take on dimensions related to the sidewalls 104. In an alternative embodiment, platform 128 may be hinged (as discussed further below with reference to FIG. 6) so as to facilitate collapsing of support structure 100. Platform 128 may be sized and configured to support tools, paint trays, buckets, or other construction tools and accessories. Ridge 132 is sized and configured to restrict the movement of items, for example, small parts, fasteners, etc., placed on platform 128.

As shown in FIG. 2, support member 120 extends through cavity 112 of each support structure 100, entering and exiting through apertures 116 residing in the same horizontal plane. The use of cavity 112 and multiple apertures 116 to hold a correspondingly sized and configured support member 120 dissuades lateral, rotational, and vertical motion of the support member 120. In an alternative embodiment, a clip, clamp, bolt, lock, or other device may be affixed to the ends of support member 120 after insertion through support structure 100. The clip would prevent removal and sliding of the support member 120 during use. In an exemplary embodiment, multiple support structures are used in combination with one or more support members to create a barrier suitable for directing traffic, blocking a driveway, or otherwise notifying persons as to the need to avoid a given area.

FIG. 3 shows a staging system 200 that includes multiple support structures 100A-D to provide a multi-tiered material rack. In this embodiment, support structures 100A-D each receive support member 120 at apertures 116 located on the same horizontal plane so as to create a plurality of material racks 148. Construction materials 152 can then be staged on each material rack 148 for storage, or, for example, when the construction materials are wood trim, the trim can be placed and painted on lower material rack 148 and then another layer of wood trim can be placed and painted on an upper material rack.

Figure 4:
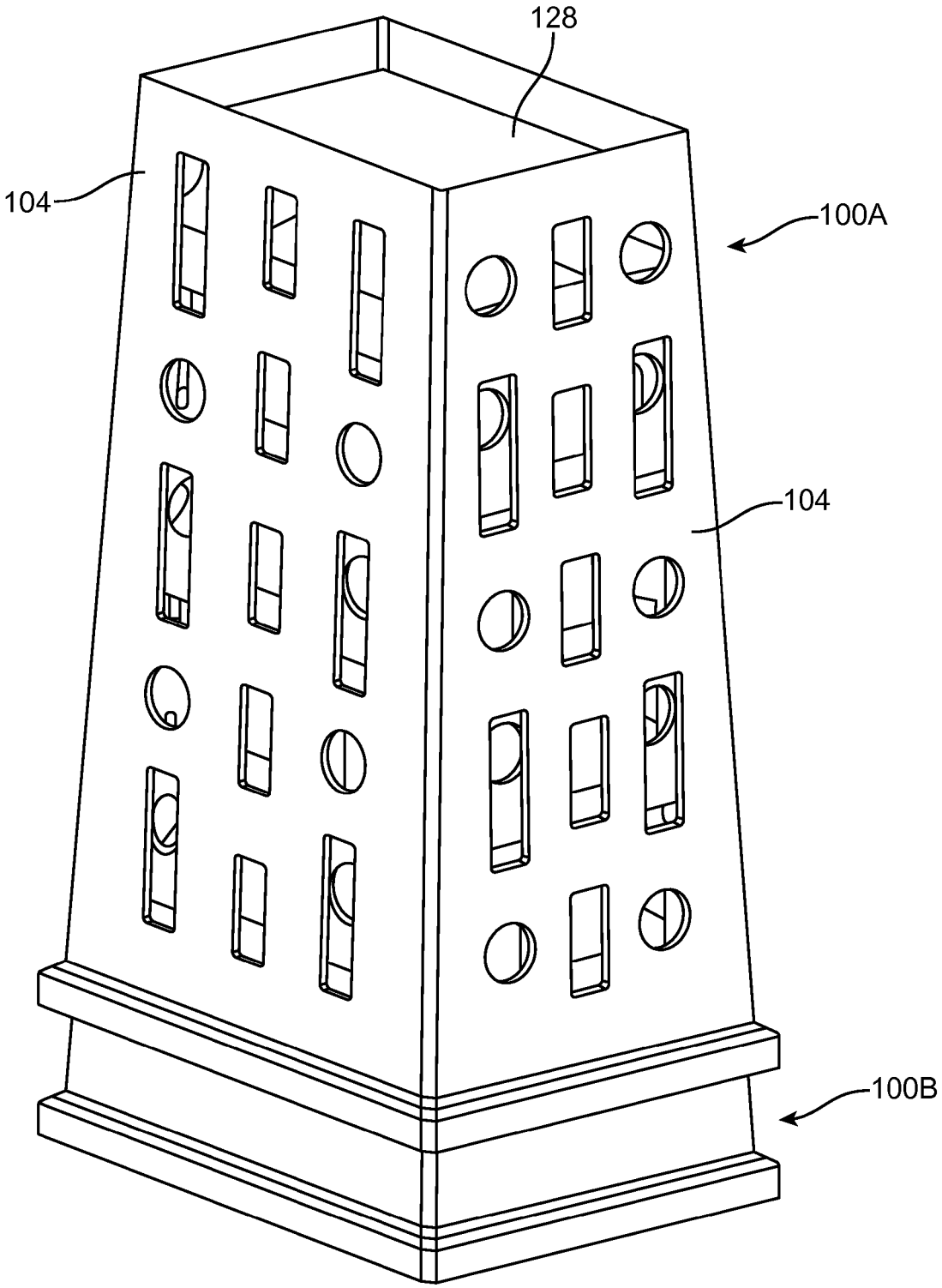
FIG. 4 is a perspective view of a nested pair of portable support structures according to an embodiment of the present invention.

FIG. 4 shows a pair of support structures 100 (support structures 100A-B) in a nested arrangement. The trapezoidal shape of each sidewall 104 facilitates the nesting of multiple support structures 100. Nesting support structures 100 improves portability and storage of the support structures. In an exemplary embodiment, each sidewall 104 diverges from a vertical central axis, C, of the support structure by about 3 degrees. The degree of diverges of side 104 may be larger or smaller than 3 degrees depending on the desired load capacity of support structure 100 and the size and configuration of the support structure. For example, if larger load capacities are desired, a lower angle may be preferable. Reducing the size of platform 128 would also permit a larger angle while maintaining the base size and height of support structure 100. In an exemplary embodiment, the degree of divergence is such that each support structure can carry loads greater than 300 pounds.

Figure 5:
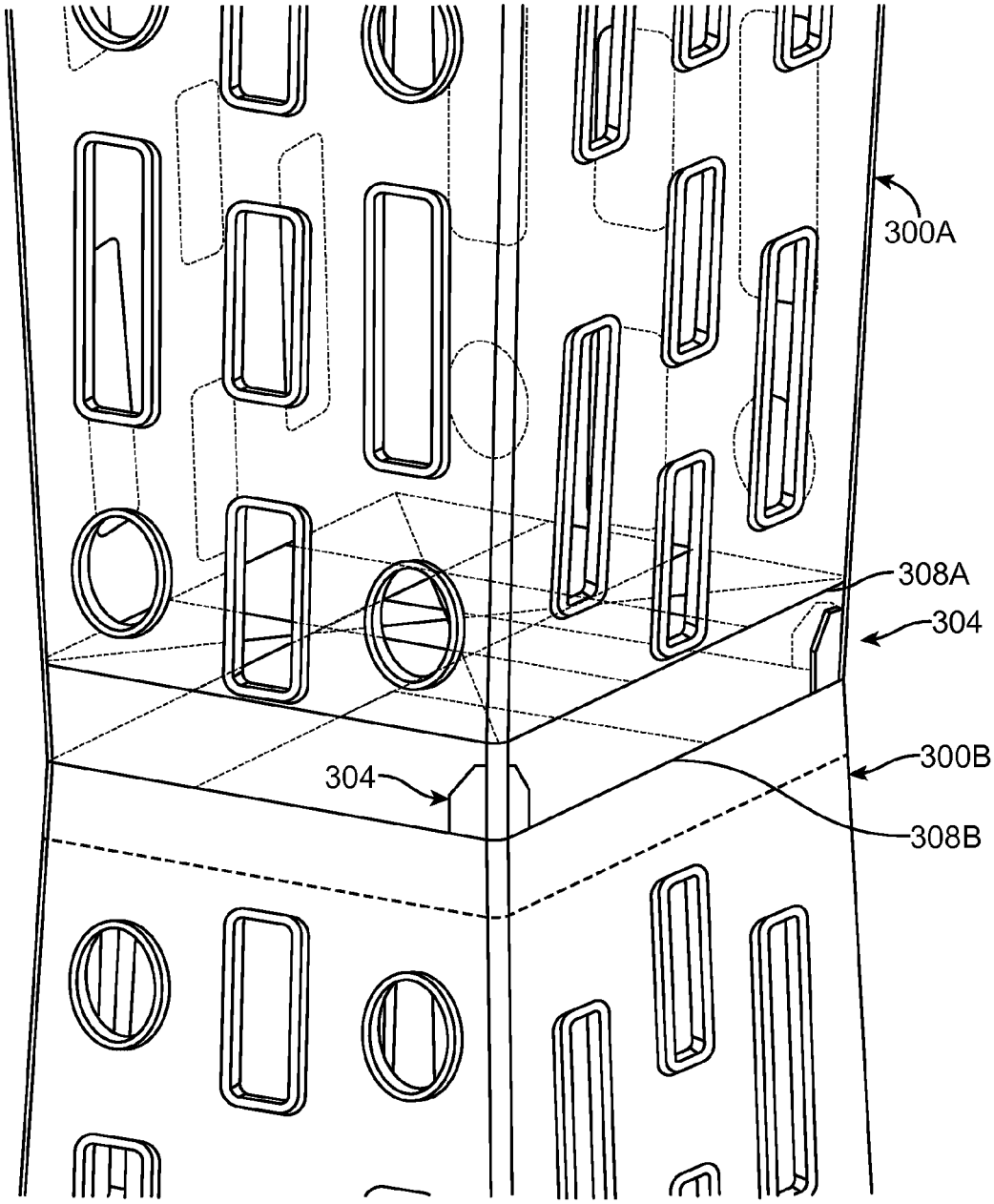
FIG. 5 is a perspective view of a pair of portable support structures in a stacked arrangement according to an embodiment of the present invention.

FIG. 5 shows two support structures 300, i.e., support structures 300A-B, in a stacked arrangement, thereby increasing the vertical storage capacity of a storing or staging system, such as staging system 200 (FIG. 3). In this embodiment, each support structure 300A-B includes a pair of interengaging projections 304 that are mounted at ridges 308A-B (disposed on support structures 300A and 300B, respectively). Interengaging projections 304 of support structure 300A are sized and configured to fit proximate ridge 308B and the interengaging projections of support structure 300B are sized and configured to fit proximate ridge 308A. Interengaging projections 304 prevent sliding, toppling, and otherwise prevent lateral movement of support structure 300A when coupled to support structure 300B.

In an alternative embodiment, support structures 300A-B are coupled via corresponding respective ridges 308 (not shown). In this embodiment, the ridge formed on support structure 300A is sized and configured to receive, in an interengaging manner, the corresponding ridge of support structure 300B.

Figure 6:
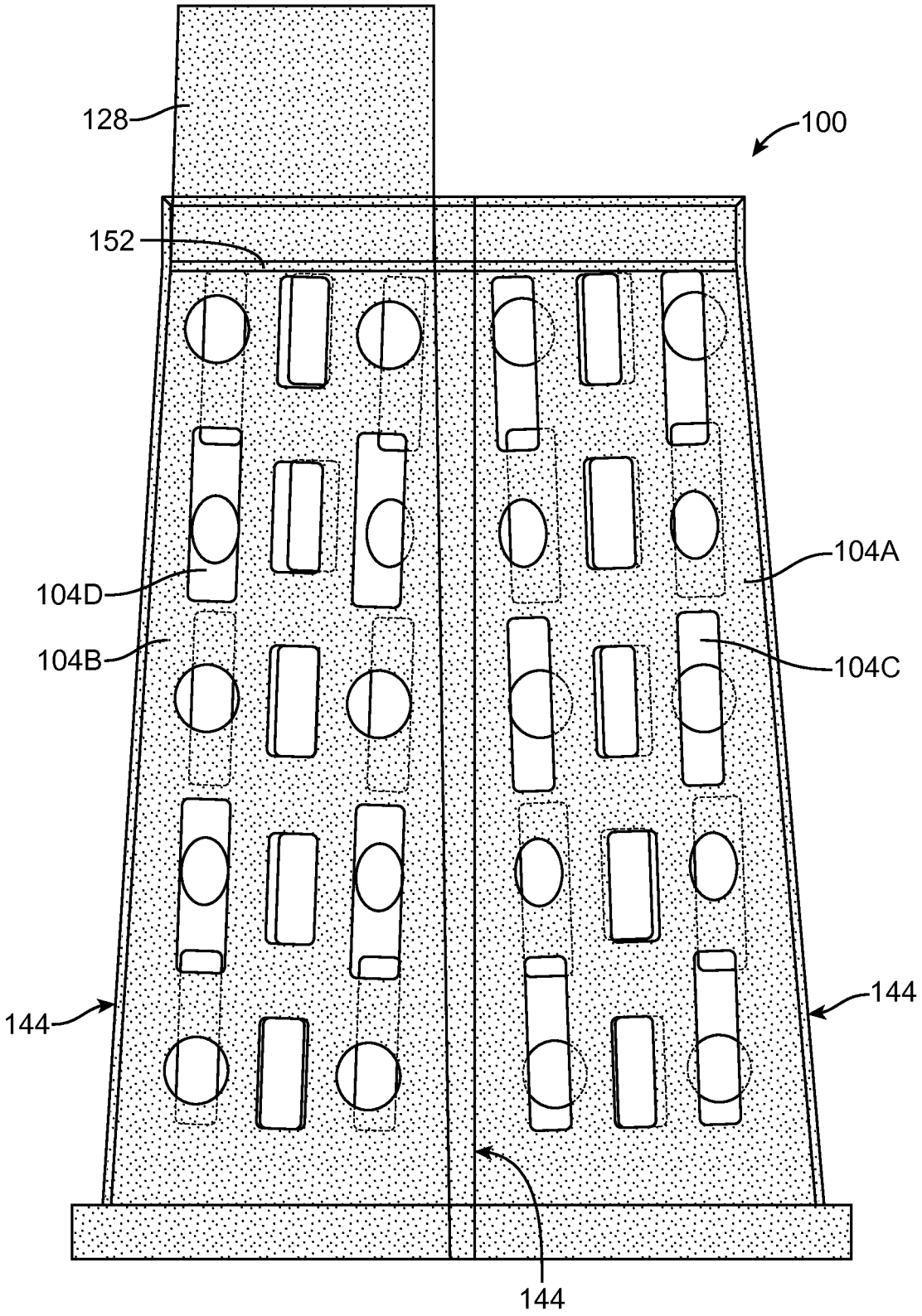
FIG. 6 is a perspective view of a portable support structure in a collapsed position.

Support structure 100 may be configured to move between a collapsed position (as shown in FIG. 6) to an operative position (as shown in FIG. 1). In the operative position, support structure 100 is configured to support work pieces or support members 120 that can provide working spaces or racks. In the operative position, sidewalls 104 can be diverging (e.g., outwardly and downwardly) away from each other to form a truncated pyramid structure. Sidewalls 104 are pivoted to an unfolded or expanded configuration. The extent of unfolding may be limited by locking hinges or braces (not shown) between sidewalls 104 or by the top 124.

Support structure 100 may be moved into the folded position simply by pivoting platform 128 about hinge 152 (such that top 124 extends away from cavity 112 or into the cavity), and then by manipulating the support structure so that sidewalls 104 pivot about edges 108 such that the sidewalls come in close proximity to each other. In another embodiment, support structure 100 may be moved into the folded position by releasing a brace or locking hinge (not shown), and then folding the support structure to bring sidewalls 104 in close proximity to each other. In the folded position, support structure 100 is a generally flat structure that may easily be transported from one place to another or stored.

Support structure 100 can be made of many materials known in the art. In an exemplary embodiment, support structure 100 is made of high density polyethylene (HDPE), which is a thermoplastic resin that is softened by heat and hardened by cooling. HDPE is abrasion resistant and has a low coefficient of friction. HDPE is also a high impact resistance (toughness) material. In an embodiment, support structure 100 is made from HDPE from Dow Chemical® HDPE-DMDA-8007-NT7. Other materials having suitable strength to weight properties may also be used, such as high-modulus polyethylene (HMPE), high-performance polyethylene (HPPE), polyethylene, or acrylonitrile butadiene styrene (ABS). Support structure 100 can be constructed using devices known in the art such as injection molding equipment.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A support structure for supporting construction materials or work pieces or for the creation of a work surface, the support structure comprising:

a plurality of sidewalls each including a pair of parallel edges and a pair of converging edges;

a plurality of first and second apertures, wherein a first aperture is disposed in a first sidewall and a second aperture is disposed in an opposing second sidewall in alignment with the first aperture, the first and second apertures being configured and dimensioned to accept and support a supporting member placed therethrough in an orientation parallel to said parallel edges; and at least one interengaging member;

wherein ones of said plurality of sidewalls are coupled along respective ones of said pairs of converging edges such that each of said converging edges couples to another of said converging edges so as to form a truncated pyramid with a hollow interior such that a first support structure may be nested inside a second support structure with both support structures in the same orientation, wherein said parallel edges form top and bottom ends, the top end being narrower than the bottom end, and wherein the top end defines an upper edge sized to contact the upper edge of a second said support structure when stacked thereon in an opposite, inverted orientation, and said at least one interengaging member is configured and dimensioned to cooperate between the support structure sidewalls along said contacting upper edges to maintain alignment between said contacting upper edges.

2. A support structure according to claim 1, further comprising a platform recessed within said hollow interior spaced from the upper edge to define a support for tools or materials.

3. A support structure according to claim 1, wherein said interengaging member is a projection.

4. A support structure according to claim 1, wherein a divergence of said sidewalls is about 3 degrees.

5. A support structure according to claim 1, wherein said apertures on adjacent ones of said sidewalls are offset in the vertical direction.

6. A support structure according to claim 1, wherein the support structure can be placed in a collapsed position and in an operational position, and wherein when said support structure is placed in a collapsed position ones of said plurality of sidewalls are proximate each other.

7. A support structure according to claim 1, wherein said first and second apertures are sized and configured to accept and support a standard wood 2×4 or a wood 2×6 with a total clearance of about 0.25 inches in each direction.

8. A support structure according to claim 1, wherein said first and second apertures are sized and configured to accept and support a length of pipe.

9. A method of staging materials, comprising:

providing plural pairs of support structures, wherein each support structures includes:

a plurality of sidewalls defining a hollow interior, and a plurality of apertures evenly distributed in the vertical direction on opposing sidewalls, wherein pairs of the plurality of apertures for each support structure reside in the same horizontal plane;

alternatively nesting the support structures for storage with one support structure received in the hollow interior of another by placing one over the other each in an upright position, or inverting one support structure and placing it in an inverted orientation on the top of another support structure to create pairs of double height support sturctures;

inserting a first support member into opposing ones of the plurality of apertures of a first pair of double height support structures;

inserting a second support member into opposing ones of the plurality of apertures of a second pair of double height support structures, wherein the first support member and the second support member create a first horizontal support plane for supporting materials placed there across;

placing materials on the first horizontal support plane.

10. A method of staging materials according to claim 9, further comprising:

inserting a third support member into another of the opposing ones of the plurality of apertures of the first pair of double height support structures; and inserting a fourth support member into another of the opposing ones of the plurality of apertures of a second pair of double height support structures, wherein the third support member and the fourth support member create a second horizontal platform residing above the first horizontal support plane for supporting materials placed there across; and placing materials on the second horizontal support plane.

* * * * *